US005224412A

United States Patent [19]

Goedecke et al.

[11] Patent Number: 5,224,412

[45] Date of Patent: Jul. 6, 1993

[54] BELT-DRIVEN ROTARY DRIVE

[75] Inventors: Wolf-Dieter Goedecke, Unterkirnach; Ralf Huber, Brigachtal, both of Fed. Rep. of Germany

[73] Assignee: Mannesmann Aktiengesellschaft, Dusseldorf, Fed. Rep. of Germany

[21] Appl. No.: 860,787

[22] Filed: Mar. 31, 1992

[30] Foreign Application Priority Data

Apr. 3, 1991 [DE] Fed. Rep. of Germany ..... 4111117

[51] Int. Cl.[5] ..... F01B 19/00

[52] U.S. Cl. ..... 92/92; 92/89; 92/120

[58] Field of Search ..... 92/89, 90, 91, 92, 120

[56] References Cited

U.S. PATENT DOCUMENTS

| | | | |
|---|---|---|---|
| 3,229.590 | 1/1966 | Huska | 92/120 |
| 4,756,237 | 7/1988 | Shishkin et al. | 92/91 |
| 4,838,148 | 6/1989 | Denker | 92/90 |

FOREIGN PATENT DOCUMENTS

| | | | |
|---|---|---|---|
| 2718528 | 11/1978 | Fed. Rep. of Germany | 92/90 |
| 0397684 | 1/1974 | U.S.S.R. | 92/91 |
| 0885740 | 11/1981 | U.S.S.R. | 92/90 |

*Primary Examiner*—Thomas E. Denion

*Attorney, Agent, or Firm*—Cohen, Pontani, Lieberman, Pavane

[57] ABSTRACT

A belt-driven rotary drive having a belt closed upon itself which is connected, within a pressure fluid-tight housing over roller-shaped bodies with the formation of movable pressure chambers, to a rotatable shaft which is extended out of the housing and the movable pressure chambers can be acted on by pressure fluid. In order further to develop a belt-driven rotary drive of this type in such a manner that the sealing action and the friction caused thereby can always be adjusted in simple manner from the outside, it is proposed that the closed belt (1) be adapted to be pressed on itself over a part of its length, with the formation of two pressure chambers which are pressure fluid-tight from each other, by a static pressing member which acts in the direction towards one of the roller-shaped bodies and that the pressing member be functionally connected for the adjustment of the pressing force with an adjusting device which is adjustable from the outside.

5 Claims, 2 Drawing Sheets

BELT-DRIVEN ROTARY DRIVE

BACKGROUND OF THE INVENTION

1. Field of the Invention

The present invention relates to a belt-driven rotary drive having a belt closed on itself which is guided over roller-shaped bodies within a pressure fluid-tight housing with the formation of movable pressure chambers, at least one of the roller-shaped bodies being connected with a rotatable shaft which is conducted out of the housing and the movable pressure chambers being adapted to be acted on by pressure fluid.

2. Description of the Related Art

A belt-driven rotary drive of this type is known from U.S. Pat. No. 4,838,148. In that case, a belt which is closed on itself is provided, with the formation of movable pressure chambers within a pressure fluid-tight housing. The pressure fluid-tight housing has within it a cylindrical hollow space in which two roller-shaped bodies are arranged alongside of each other. One of the roller-shaped bodies is stationary, i.e. non-rotatable, within the hollow space and lies completely within the kidney-shaped ring formed by the closed belt. The second roller-shaped body is rotatable around a centrally extending shaft and is connected with a shaft which extends towards the outside.

The stationary roller-shaped body is provided with two diametrically opposite openings of pressure-fluid lines, which openings, by the action of pressure-fluid, shift the belt or the pressure chambers formed in each case thereby to one side or the other, depending on which of the openings is selected. A toothing arranged on the outer circumference of the belt engages in the rotatable roller-shaped body, which is provided with a complementary toothing so that the movement of the belt is transmitted to the rotatable roller-shaped body. This rotary movement produced in this fashion can be tapped off from the shaft on the outside. In this connection, the two cylindrical bodies are so close together that a suitable sealing closure is assured between the pressure chambers produced by the closed belt.

This known rotary drive has the disadvantage that the sealing action cannot be readjusted and that, upon increased wear of the belt, the sealing action also declines.

SUMMARY OF THE INVENTION

Accordingly, it is the object of the invention so to develop a belt-driven rotary drive of this type that the sealing action and the friction caused thereby are at all times adjustable in simple manner from the outside.

This object is achieved, in accordance with the invention, in the belt-driven rotary drive of the type in question in the manner that the closed belt, with the formation of two pressure chambers which are pressure fluid-tight with respect to each other, can be pressed together over a part of its length by a static pressing member which acts in the direction towards one of the roller-shaped bodies, and that the pressing member is functionally connected with a setting device which is adjustable from the outside in order to adjust the pressing force.

The advantage is hereby obtained that, upon progressive wear of the belt, which makes itself noticeable essentially by a thinning of its wall thickness, the pressing force can always be readjusted. In other words, sealing action and friction are adjustable from the outside. Another advantage is that one can do without additional sealing elements, since the required sealing action is obtained solely by the pressing of sections of the belt against each other. Another advantage is that in this way one can influence the friction thus produced within the rotary drive. This can be utilized advantageously, for instance, in the manner that the friction can be adapted to a controller which controls the rotary drive. Thus, by the influence on the frictional value, the operating behavior of the rotary drive can be directly influenced. One can, for instance, subject to the compromise of a weaker seal, produce a faster rotary movement. Accordingly, it is also possible, by increasing the friction, to obtain a correspondingly slower rotary drive. Depending on the purpose, one or the other possibility can be utilized.

As an advantageous feature of the invention, three roller-shaped bodies are arranged within the pressure fluid-tight housing, each being mounted for independent rotation and being so arranged that one of the roller-shaped bodies is arranged in the center and is connected with the shaft extended towards the outside, and that the other two roller-shaped bodies are so arranged in planet-like manner that the connecting lines between their points of rotation and the point of rotation of the central roller-shaped body form an obtuse angle. Thus, in this arrangement there is then obtained—in a further advantageous development—the result that the pressing member acts in the direction towards the central roller-shaped body and that, in the region of its surface pressing against the belt, the pressing member is curved in accordance with the curvature of the sections of the belt conducted over the central roller-shaped body. In this way, a correspondingly large section over which the belt can be pressed together is established. The fact that this pressing together has, in this case, a certain length and is thus more than line contact or line pressing, provides assurance that sufficient sealing action is present even upon only weak application. A final advantageous feature provides that, the adjusting device is an adjustment screw which is conducted out of the housing, whereby a structurally simple adjustment means is provided.

DESCRIPTION OF THE PREFERRED EMBODIMENT

Figure 1:
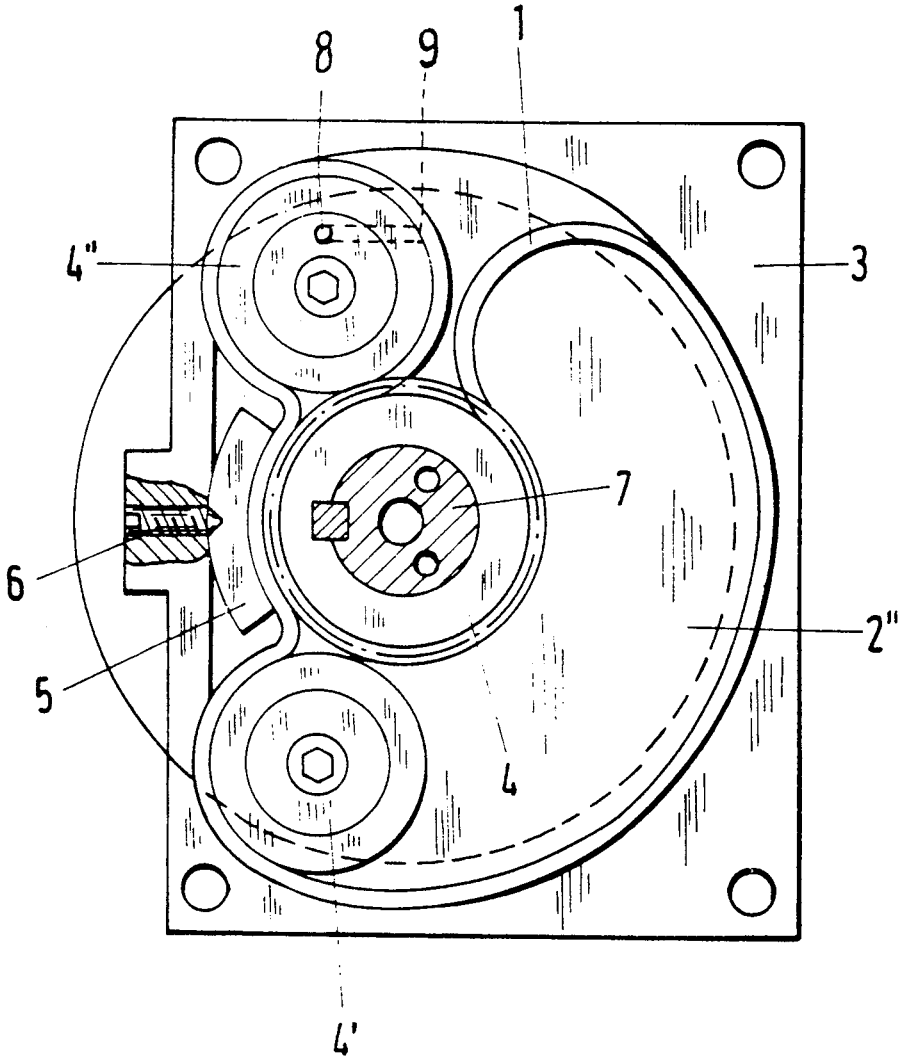
FIG. 1 is a partially sectional view of the belt-driven rotary drive according to the present invention.
Figure 2:
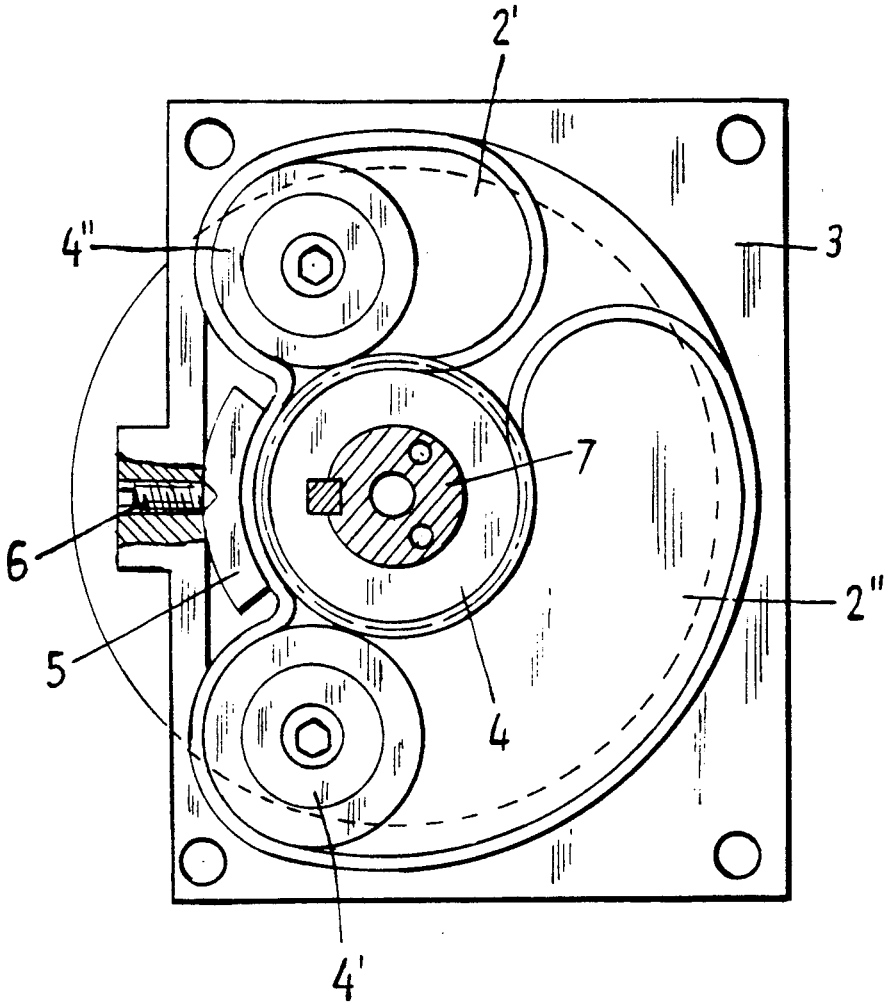
FIG. 2 is a partially sectional view of the rotary drive in FIG. 1, shown in a different operating position.

The drawing shows a preferred embodiment of the belt-driven rotary drive proposed by the invention in which the rotary drive is shown in open condition with a view of all important details. In FIG. 1 the closed belt 1 is shown in one of its two possible end positions. In this end position, the belt 1 forms a pressure chamber 2''. The belt 1 is passed over the central roller-shaped body 4 which is connected to the shaft 7 which extends to the outside and via which the rotary movement can be tapped off outside the housing 3. The two roller-shaped bodies 4', 4'', which are arranged in planet-like manner and in connection with which the lines connecting their axes of rotation to the center point of rotation of the central roller-shaped body 4 form an obtuse angle, has the result of producing a correspondingly large section over which the belt sections can be pressed against each other. These belt sections extend over part of the circumference of the central roller-shaped body 4. The remaining section of the belt form movable pressure chambers 2', 2''. The pressure chambers are moved by applying a pressure fluid. Thus, when applying a pressure fluid through duct 8 and opening 9 in roller body 4'', the pressure chamber 2' expands, and the other pressure chamber 2'' contracts as pressure fluid is discharged through an opening 9 and a duct 8, not shown, provided in roller body 4' corresponding to the configuration of roller body 4''. The pressing member 5 for pressing the corresponding sections of the belt against each other has a curvature which corresponds to the curvature of the central roller-shaped body or the sections of the belt guided over it. In this way, optimal application is obtained over the entire length of the pressing member 5. The pressing member 5 is in direct functional connection with an adjustment screw 6 which extends to the outside and via which the pressing force of the pressing member on the belt sections can be adjusted from the outside. Theoretically, it is thus possible to adjust the sealing action up to eventual disintegration of the belt and thus increase the total life of the rotary drive.

The belt itself consists of an elastic material which can be developed with or without toothing on its outer circumference. In order that the belt can produce, pressure fluid-tight movable pressure chambers 2' and 2'' within the housing, its width must be such that it rests in pressure fluid-tight manner within the housing against the bottom and cover of the housing. For this purpose, the belt is beveled in the regions of its edges, forming sealing knife edges, so that optimal sealing action is obtained while minimizing the friction.

As a whole, with the sealing of the movable pressure chambers by the externally adjustable pressing member proposed in accordance with the invention, a structurally simple shape of the rotary drive is furthermore obtained. The adjustability of the pressing member, which, on the one hand, affects the sealing action and, on the other hand, also the friction, can be utilized in many advantageous ways. As a result of the possibility of adjusting the application force up to complete disintegration of the belt, optimal sealing action is always obtained. Furthermore, due to the possibility of controlling the friction, the rotary drive can also be regulated accordingly.

We claim:

1. A belt-driven rotary drive comprising a pressure medium-tight housing, roller-shaped bodies, each having a center axis, the roller-shaped bodies being mounted in the housing, a closed belt arranged guided on the roller-shaped bodies such that a first belt portion contacts a second belt portion resulting in two movable pressure chambers formed by the closed belt, the movable pressure chambers being pressure medium-tight relative to each other, at least one of the roller-shaped bodies being connected to a rotatable shaft extending out of the housing, means for admitting pressure medium to the movable chambers, a stationary pressing member for applying a pressing force against the contacting portions of the belt and toward one of the roller-shaped bodies, and an adjusting device for adjusting the pressing force of the pressing member, the adjusting device being mounted so as to be accessible from outside the housing.

2. The belt-driven rotary drive according to claim 1, comprising three roller-shaped bodies, each being rotatable about the center axis thereof, the three roller-shaped bodies being arranged such that one of the roller-shaped bodies is int he middle between two outer roller-shaped bodies, the rotatable shaft being connected to the middle roller-shaped body, wherein, in a plane extending perpendicularly to the center axes of the roller-shaped bodies, connecting lines between the center axes of the outer roller-shaped bodies and the middle roller-shaped bodies include an obtuse angle.

3. The belt-driven rotary drive according to claim 2, wherein the pressing member is mounted such that the pressing force is directed toward the middle roller-shaped body.

4. The belt-driven rotary drive according to claim 2, wherein the contacting belt portions extend around the middle roller-shaped body, the contacting belt portions having a curvature, the pressing member for applying the pressing force against the contacting portions of the belt having a curvature which corresponds to the curvature of the contacting portions of the belt.

5. The belt-driven rotary drive according to claim 1, wherein the adjusting device comprises an adjusting screw extending out of the housing.

* * * * *